United States Patent [19]

Manning

[11] 4,295,784

[45] Oct. 20, 1981

[54] VARIABLE STATOR

[75] Inventor: Frank B. Manning, Vernon, Conn.

[73] Assignee: United Technologies Corporation, Hartford, Conn.

[21] Appl. No.: 78,980

[22] Filed: Sep. 26, 1979

[51] Int. Cl.[3] ..... F01D 17/16

[52] U.S. Cl. ..... 415/162

[58] Field of Search ..... 415/160, 161, 162

[56] References Cited

U.S. PATENT DOCUMENTS 2,858,052 10/1958 Allen ..... 415/149

3,066,488 12/1962 Mock ..... 415/161

3,458,118 7/1969 Burge et al. ..... 415/160

FOREIGN PATENT DOCUMENTS 2003988 3/1979 United Kingdom ..... 415/162

*Primary Examiner*—Louis J. Casaregola

*Attorney, Agent, or Firm*—Norman Friedland

[57] ABSTRACT

The linkage system for a variable stator vane is made to achieve different rates between stages of stators in a variable stator configuration for an axial flow compressor of a turbine type power plant. The actuator-linkage arrangement permits nesting of the actuator providing a compact design.

4 Claims, 2 Drawing Figures

VARIABLE STATOR

BACKGROUND OF THE INVENTION

This invention relates to gas turbine engines having stages of axial flow compressors and particularly to means for varying the rate of change of different stages of variable stators in the compressors.

As is well known, variable stators are desirable for improving performance of the compressor and there are many mechanisms available to achieve this end. However, what is most desired is to match the vane angle of the various stators with a specific schedule and the nature of the schedule is such that for a given engine requirement the angle of the stator and its schedule for different stages should be different. Thus, it is desireable to tailor each stage of stators to more closely match the schedule and to do so within the confines of the linkage system, bearing in mind the weight and complexity of the system. Exemplary of such system is U.S. Pat. No. 2,858,062 granted to R. C. Allen on Oct. 28, 1958 showing variable stator mechanism.

I have found that I can closely match the stator vane schedule of a turbine type power plant by having the actuator drive certain stages of the variable stator and having a linkage system driven by the driven states driving the linkage system of the other stator stages. The actuation system can be made more compact than heretofore systems by reversing the linkage connection to the stator vanes and nesting the actuator under the linkage system and applying a horizontal (relative to the engine's axis) rectilinear movement.

SUMMARY OF THE INVENTION

An object of this invention is to provide for an axial flow compressor improved stator vane linkage system by having different rows of vanes being positioned at different rates and having different angles for a given position to more closely adhere to a prescribed schedule. A feature of this invention is to drive one set of vanes directly by the actuator and another set of vanes being driven by a linkage system by the actuator driven mechanism.

Another feature is the arrangement of the linkage with respect to the vanes so as to nestle the actuator for reducing the actuating system's envelope size.

Other features and advantages will be apparent from the specification and claims and from the accompanying drawings which illustrate an embodiment of the invention.

DESCRIPTION OF THE PREFERRED EMBODIMENT

Figure 1:
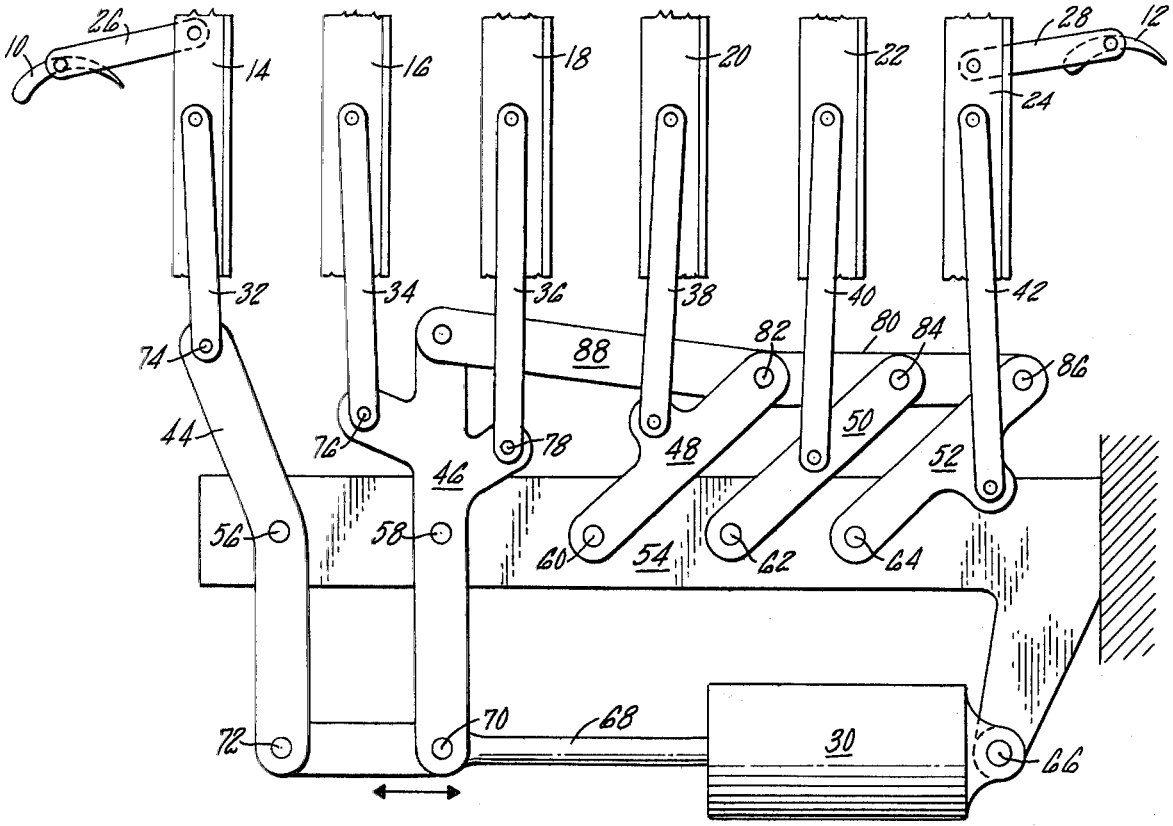
FIG. 1 is a partial view in schematic showing the details of this invention.

Referring to FIG. 1, the linkage system for achieving the variable stator vane profile is shown in schematic and the engine casing and typical mechanical details are eliminated herefrom for the sake of convenience and simplicity. For more detail, the actuation system utilized on the JT-9D engine manufactured by Pratt & Whitney Aircraft Group, Division of United Technologies Corporation and the system disclosed in U.S. Pat. No. 2,999,630 are typical and are incorporated herein by reference. Suffice it to say that the purpose of the actuator/linkage system is to vary the vane angles to match the schedule in FIG. 2. As noted from FIG. 2 the rate of change of the front stages illustrated by the dash line A in a plot of percentage of rotor speed of the engine for varying vane angles is different than the rate of change of the rear stages illustrated by dash line B.

The next portion of this description will deal with the mechanism for achieving the different rate of changes between these stages. Again referring to FIG. 1, the rows of stator vanes are simply illustrated by the single vanes 10 and 12 and as will be appreciated each synchronizing ring 14, 16, 18, 20, 22 and 24 are similarly attached to the vanes for vane angle movement. As noted, the vane lever arms 26 and 28 serve to interconnect the rings 14 and 24 so that rotation of the ring in the vertical position as viewed from the drawing rotates the vane, changing its angle of attack relative to the flow of the airstream through the compressor. Each vane has an identical connection. However, the lever arms 26 and 28 are reversed to shorten the envelope size and allow actuator 30 to be nested under the linkage mechanism.

As is apparent from the foregoing, the respective synchronizing rings are driven by push links 32, 34, 36, 38, 40 and 42 which in turn are connected to the crank arms 44, 46, 48, 50 and 52, respectively, which are in turn pivotally mounted to the fixed support members 54. Thus, pivoting of the respective crank arms pivotally connected to support 54 by pivots 56, 58, 60, 62 and 64, respectively causes the synchronizing rings to rotate, causing, in turn, the stator vanes to rotate.

Actuator 30, supported to the fixed support 54 at pin connection 66 serves to position the actuating rod 68 rectilinearly and according to this invention drive the three front rows of vanes that are attached to rings 14, 16 and 18. Hence, crank arms 44 and 46 are suitably attached to actuating rod 68 via the pin connections 70 and 72 and obviously causing these crank arms to pivot about pivot points 56 and 58 to position links 32, 34 and 36, also suitably attached thereto by pin connections 74, 76 and 78.

The three rows of vanes on the rear side of the compressor attached to rings 20, 22 and 24 are ganged together by link 80 suitably pinned to crank arms 48, 50 and 52 by pins 82, 84 and 86, respectively, and are driven by drag link 88. Drag link 88 is pivotally supported to crank arm 46 by pin 90 and connected to link 80 by the pin 82. Hence, movement of crank arm 46 in turn positions link 80 which positions the connecting synchronizing links.

Figure 2:
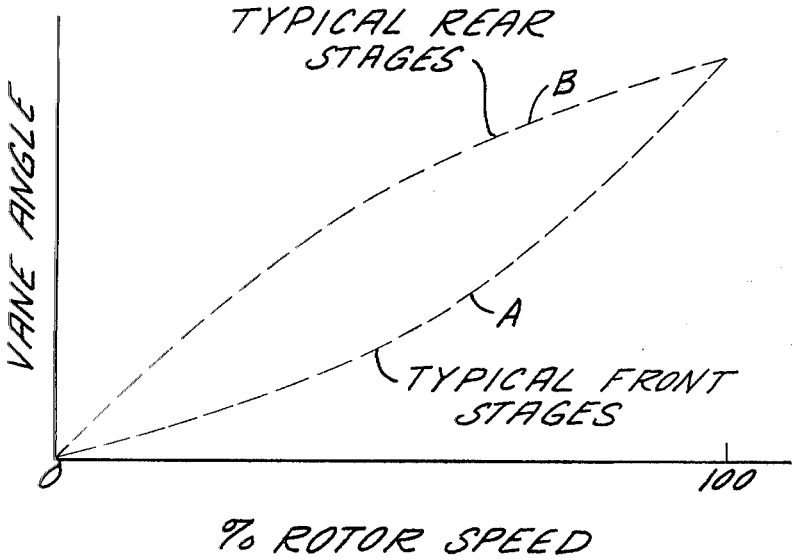
FIG. 2 is a graph plotting vane angle versus rotor speed showing a typical schedule achievable by the linkage system.

By affixing crank arms 48, 50 and 52 at an angle relative to the central horizontal plane of the support 54 which is different than the angle that crank arms 44 and 46 make relative to the same plane produces a different rate of change of the attaching vanes and the particular angle will produce the slope of curves A and B of FIG. 2.

As is apparent from the foregoing, since the relationship of the angle of the crank arms of the two crank arms affixed to the front stages is different from that of the front stages the curves A and B will result. The slope of these curves can be made to vary by selecting the corresponding angle.

It should be understood that the invention is not limited to the particular embodiments shown and described herein, but that various changes and modifications may be made without departing from the spirit and scope of this novel concept as defined by the following claims.

I claim:

1. A stator vane actuation system for a compressor of a gas turbine engine including a plurality of axially spaced rows of circumferentially pivotally mounted vanes, an actuator having a connecting rod, a synchronizing ring for each row of vanes mounted external of the engine connecting each vane for pivotal movement, means interconnecting said connecting rod and at least one of said synchronizing rings for positioning each of said vanes in said row upon actuation of said actuator, linkage means connecting said interconnecting means and at least a second synchronizing ring so that actuating said actuator positions said one synchronizing ring for moving said one row of vanes at a given rate and the movement of said second synchronizing ring for moving the attached row of vanes to said second synchronizing ring at a different rate, a fixed elongated member, bell crank means for each of said synchronizing rings pivotally mounted on said fixed elongated member, means interconnecting said bell crank and said synchronizing rings, the bell crank means actuating said one synchronizing ring and the bell crank means actuating said second synchronizing ring being disposed at respectively different angles relative to said elongated member.

2. A stator vane actuating system as in claim 1 including a connecting lever interconnecting each of said vanes in a given row to its respective synchronizing ring, the direction of connecting the vanes of the first of said axially spaced rows being in allochiral relationship with the direction of connecting the vanes of the last of said axially spaced rows.

3. A stator vane actuation system as in claim 2 wherein said actuator is disposed between said first of said axially spaced rows and said last axially spaced rows.

4. A stator vane actuation system as in claim 2 including a connecting link interconnecting each of said bell cranks and said synchronizing rings and said actuator being supported to said fixed elongated member.

* * * * *